United States Patent [19]

Torii

[11] Patent Number: 4,605,224

[45] Date of Patent: Aug. 12, 1986

[54] EXERCISE APPARATUS

[75] Inventor: Masakatsu Torii, Hatogaya, Japan

[73] Assignee: Saitama Kako Co., Ltd., Hatogaya, Japan

[21] Appl. No.: 609,698

[22] Filed: May 14, 1984

[51] Int. Cl.[4] ..... A63B 23/04

[52] U.S. Cl. ..... 272/146; 272/33 A; 272/97; 272/128; 273/1 GF; 273/141 R

[58] Field of Search ..... 272/146, 97, 128, 33 R, 272/111, 144, 93, 33 A, DIG. 5; 273/1 GF, 141 R; 446/236, 256, 242

[56] References Cited

U.S. PATENT DOCUMENTS

| | | | |
|---|---|---|---|
| 2,051,366 | 8/1936 | Catron | 272/128 X |
| 3,024,021 | 3/1962 | Coplin et al. | 272/146 |
| 3,389,910 | 6/1968 | Kanzler, Jr. | 272/146 |
| 3,509,660 | 5/1970 | Seymour | 272/128 X |
| 3,612,520 | 10/1971 | Chang | 272/146 |
| 4,193,592 | 3/1980 | Bishow | 272/33 R X |
| 4,480,831 | 11/1984 | Müller-Deinhardt | 272/128 |
| 4,509,743 | 4/1985 | Lie | 272/97 |

*Primary Examiner*—Richard J. Apley
*Assistant Examiner*—David J. Brown
*Attorney, Agent, or Firm*—Irvin L. Groh

[57] ABSTRACT

Exercise equipment is disclosed which comprises a spherical sector-shaped member with an upright column erected therein, a base plate mounted on the upper end of said column, an arm with the base end rotatably carried on said column and the free end projecting outwardly from the gap between the spherical sector-shaped member and the base plate. When the user stands on the base plate bodily movement rotates the rotatable arm. The number of rotations of the rotatable arm is indicated by a display device connected to an electric detection circuit while at the same time an audible signal is sounded every time the rotatable arm makes one rotation so that the user can detect his or her progress related to the dynamic equilibrium while practicing a willful exercise with pleasure.

5 Claims, 4 Drawing Figures

EXERCISE APPARATUS

BACKGROUND OF THE INVENTION

The present invention relates to exercise apparatus equipment for training the physical balance function and more particularly to exercise equipment in the form of a spherical sector enabling the user who tries to keep exercising thereon as long as possible to enhance the bodily function related to dynamic equilibrium and also improve the function of various muscles to produce motion, such as those located in the legs and waist, while deriving agreeable amusement from the exercise.

The physical balance function among those related to movements in general serves, in its static aspect, to maintain an upright posture and in its dynamic aspect, when walking or during other bodily actions. It is of much importance to improve the balance function. There have been so far proposed several devices for training and improving this bodily balance function. An example is a pair of load meters on which a person stands upright on both feet to calculate the shifting of the center of gravity. In another example, a person tries to maintain upright posture on the flat surface of an axially halved cylinder. However, such devices, on which the users endeavor to remain still in upright posture as long as possible, only serve to evaluate the function related to the static equilibrium and do not require the users to make active motions thereon. Therefore the users tend to lose interests in the use of such equipment and abandon the use eventually.

SUMMARY OF THE INVENTION

The present invention has eliminated the above drawbacks and aims at providing exercise equipment substantially in the form of a spherical sector which not only allows the user to attempt to maintain the static body balance as he stands upright on its flat base but also enables the user to train the bodily function related to the dynamic equilibrium as he tries to use body motion to turn a rotatable arm which is pivotally carried at the center of the exercise equipment.

Another object of the invention is to provide exercise equipment which encourages use because of its agreeable recreational aspect and challenge to the skill of the user to increase speed and time of balance.

Yet another object of the invention is to provide exercise equipment which helps train the skillful and accurate aspect of the movement of the legs and waist as well as the swiftness and promptitude of muscles through bending and stretching the legs quickly at any time and shifting the center of gravity of the user's body, in an attempt to rectify the disturbed balance of the body on the equipment which is supported by a point on the floor surface so as not to fall off the exercise equipment.

Still another object of the present invention is to provide exercise equipment furnished with an electric circuit for detecting and indicating the number of rotations of said rotatable arm which is turned by the user's bodily motions, thus encouraging the user to practice a willful exercise in which the user tries to attain a larger number of rotations than in the previous round.

A further object of the invention is to provide exercise equipment furnished with an electric circuit adapted to generate voice or other desired sound each time the rotatable arm completes one rotation so that the number of sounds in unit time or the characteristics of the rhythmical sounds produced by the user's bodily motions may enable the cleverness, skillfulness, accuracy, swiftness, and the like of the balancing movements to be evaluated.

A still further object of the invention is to provide exercise equipment allowing the user to train the bodily function related to balancing motion while providing fun of games and recreation as the user, assuming upright posture on the flat base of the equipment, tries to stop his active motion for turning the rotatable arm so as to fix the arm end at a desired point of the circumference of the equipment.

DETAILED DESCRIPTION OF THE PREFERRED EMBODIMENT

The invention will now be described in detail with reference to the drawings in which.

Figure 1:
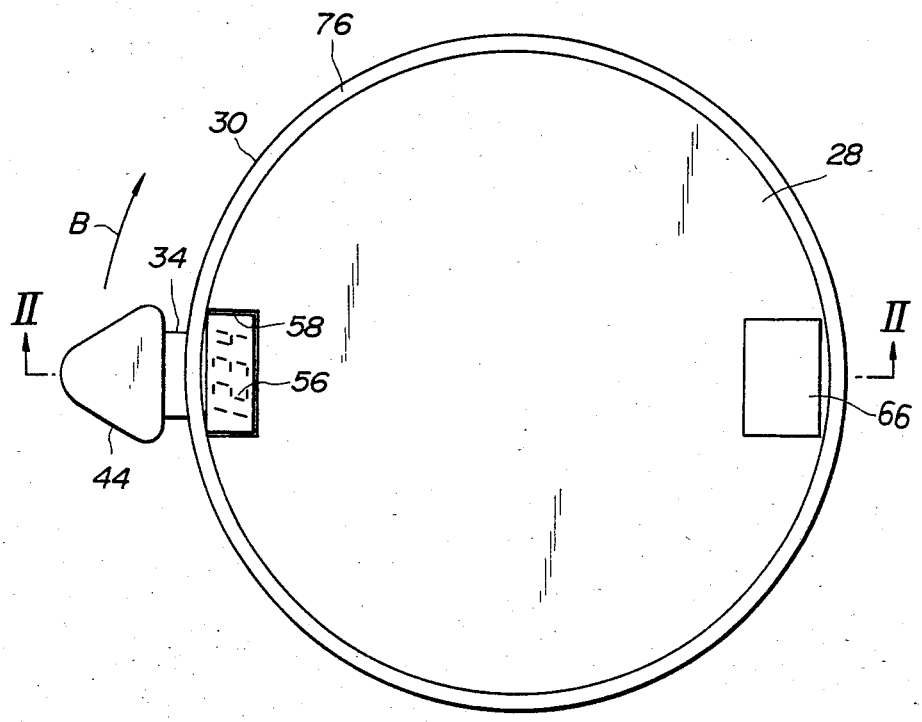
FIG. 1 is a top plan view showing an embodiment of the exercise equipment according to the invention.
Figure 2:
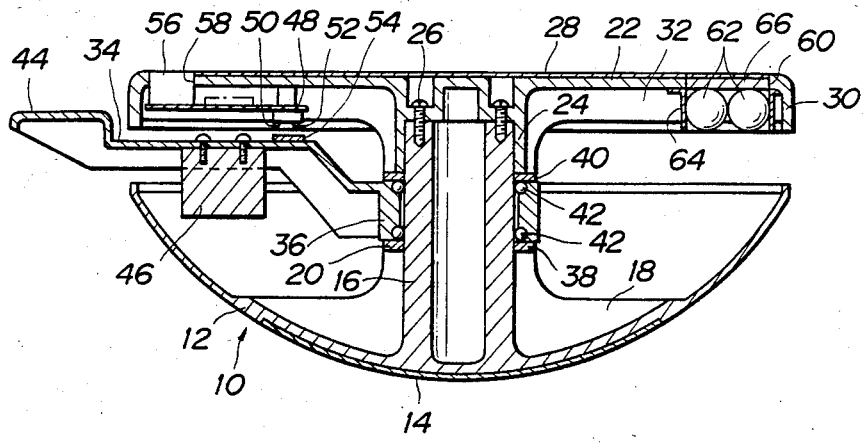
FIG. 2 is a cross section along the line II—II in FIG. 1.

Referring to FIGS. 1 and 2, an embodiment of the exercise equipment according to the invention is designated by reference numeral 10. Usually the exericse equipment 10 is molded of a hard synthetic resin such as polystyrene but may be formed of light metal. The portion of the exercise equipment 10 that contacts the floor surface is formed by a spherical sector-shaped member 12. In the outer surface of the spherical sector-shaped member 12 is fixedly fitted a spherical sector-shaped rubber member 14 having a smaller radius than the spherical sector-shaped member 12. The rubber member 14 prevents slip and also serves as a buffer against the floor surface. A hollow colum 16 of a circular cross section extends from the center of the upper surface of the base member 12 toward the center of the sphere. Between the colum 16 and the spherical sector-shaped member 12 are provided a plurality of ribs 18 radially extended from the column 16 to support the column 16 firmly. The upper ends 20 of the ribs 18 adjacent the column 16 form horizontal support areas. A base plate 22 is fixedly secured to the upper end of the column 16. From the center of the lower surface of the base plate 22 a cylindrical member 24 extends downwardly and forms a connecting means which is fitted on and secured to the column 16 by a plurality of screws 26. To the upper surface of the base plate 22 a rubber sheet 28 is bonded to prevent the user from slipping. The base plate 22 is provided at its periphery with a flange 30 directed downwardly. On the lower surface of the base plate 22 are formed a plurality of ribs 32 radially extending from the cylinder 24 to the flange 30. The radially inner ends of the ribs 32 extend to the lower end of the cylindrical member 24 which act together to form an engagement surface. A boss 36 is formed at the inner end of a rotatable arm 34 is mounted on the column 16 between the engagement portion 20 formed by the upper ends of the ribs 18 and the lower end surface of the cylindrical member 24. At the upper and lower ends of the boss 36 are provided nylon-made washers 38, 40, respectively. Steel balls 42, 42 are inserted between the washers 38, 40 and the boss 36 to allow the rotatable arm 34 to turn smoothly. The free end of the rotatable arm 34 projects outwards from a gap between the upper rim of the spherical sector-shaped member 12 and the flange 30 of the base plate 22. The rotatable arm extends upwardly at an angle from its base end until it is directed horizontally toward the outside. The arm head 44 is formed like an arrowhead and is enlarged to be easily recognizable. A weight 46 is secured intermediate the ends and on the lower surface of the rotatable arm 34. The weight 46 is provided to accelerate the rotatable arm rotated by the movement of the user's legs on the base plate 2 and/or help keep the rotatable arm turning smoothly by inertia. The weight 46 may be fixed adjacent to the arm head 44 to increase the turning force.

As shown in FIG. 2, an electric circuit board 48 is secured to the underside of the base plate 22. On the circuit board 48 a light emitter 50 is provided consisting of light emitter diodes and a photo detector 52 made up of photo diodes or photo transistors. A reflection mirror 54 is fixed on top of the rotatable arm 34 in opposition to both elements 50 and 52. On the upper surface of the circuit board 48 is provided a digital display device 56 which indicates digits by 7 liquid-crystal segments. The display device 56 is exposed through an opening 58 and its upper surface is level with that of the base plate 22 so as to be readily recognizable. An opening 60 is formed diametrically opposite to the opening 58 under which a box 64 is provided to removably accommodate batteries 62. A removable lid 66 is provided over the opening 60.

Figure 4:
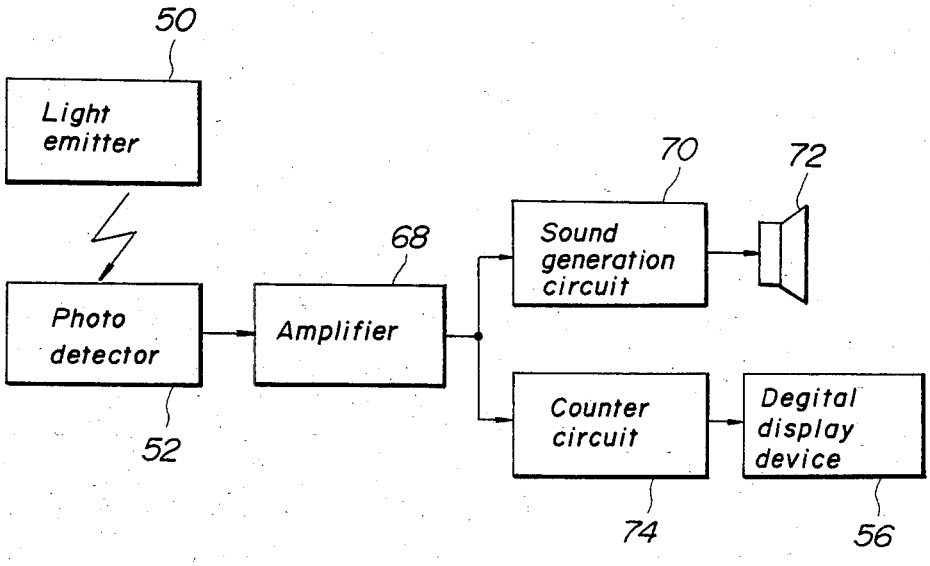
FIG. 4 is a block diagram showing an electric circuit provided on the embodiment of the invention for detecting and displaying the rotation of the arm.

FIG. 4 shows an electric circuit including the circuit provided on said circuit board 48. Each time the rotatable arm 34 makes on rotation, the light emitter 50 energized by the battery 62 emits light which is reflected by the reflection mirror 54. The reflected light arrives at the photo detector 52, whereon a pulse signal is produced in the photo detector 52 and applied to an amplifier 68. The pulse signal amplified by the amplifier 68 is supplied through a sound generation circuit 70 to a piezoelectric loudspeaker 72 which generates a desired sound. The sound employed is selected from among those which will encourage the user to practice willful exercises thereon and voice may, for instance, be reproduced. Meantime the pulse signal produced from the amplifier 68 is applied to a counter circuit 74. Every rotation of the rotatable arm 34 is counted by the counter circuit 74 of which the count is indicated by numerals in the digital display device 56.

Figure 3:
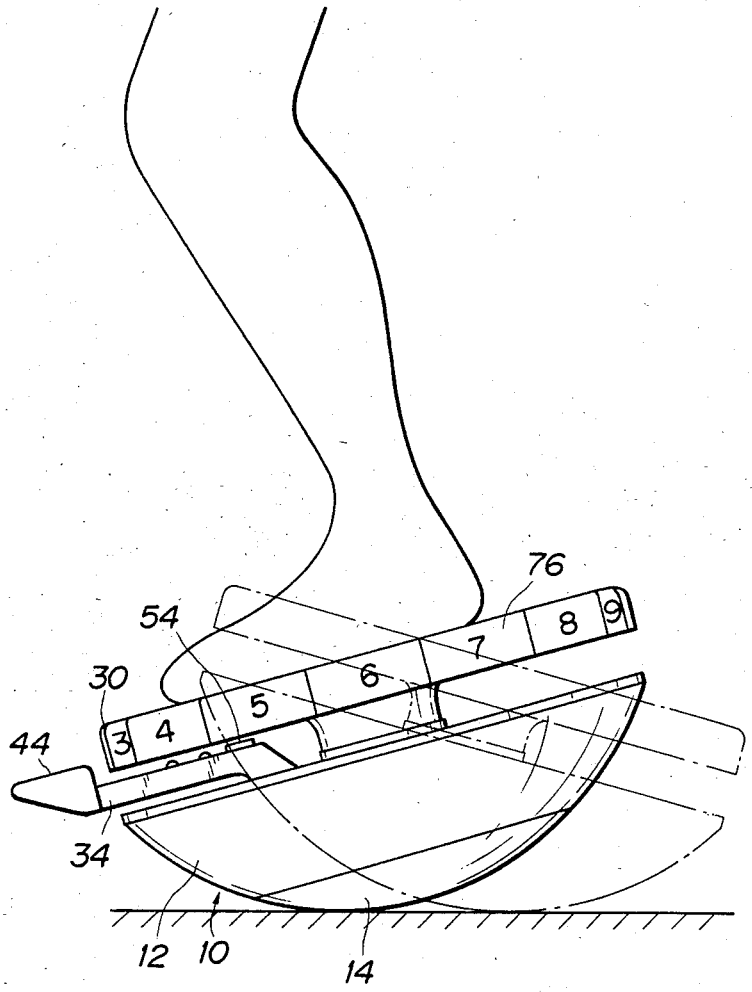
FIG. 3 is an elevation showing the preferred embodiment of the invention supporting a user.

The operating of the embodiment and the user's motions will now be described with reference to FIG. 3. First the user's feet are placed on the base plate 22 of the exercise equipment 10 with the knees bent as shown in FIG. 3, and with hands on a wall, frame or the like to support a standing posture. Practice, however, makes it possible for the user to step on the base plate without the aid of a support. Then the feet are tilted as incline the equipment 10 as shown by the solid line in FIG. 3, causing the arm 34 to rotate. Meanwhile the user is required in principle to make an effort not to shift the center of gravity in his body. For that purpose, the head and chest are to be kept still whereas the knees are bent to offset the distance by which the heels were raised. To prevent the center of gravity in the user's body from shifting as a result of the feet having moved forward, the waise is moved somewhat backward. In order to turn the rotatable arm 34 clockwise, the user lays his weight more on the right foot to urge on the right side of the base plate 22 with the right foot while moving the waist somewhat leftward. Next the feet are so tilted as to incline the sports equipment backward as shown by a chain-dot line to move the rotatable arm 34 located at the right side of the equipment backward. Since, at this time, the heels are lowered, the knees are somewhat stretched while the waist is moved forward slightly. Then the symmetric bodily position of the feet and waist to that taken to turn the rotatable arm 34 rightward is assumed to turn the rotatable arm leftward. Through these motions, the rotatable 34 is turned clockwise. Once the rotatable arm starts turning, it has a tendency to keep on turning by inertia while the turning arm is accelerated by the two motions of tilting the feet backward and forward and alternately shifting weight between the left and right foot. These bodily motions are so made as to rotate the rotatable arm 34 and keep it turning while maintaining bodily balance to keep the user's from falling off the exercise equipment 10.

When the user makes the above motions with the exercise equipment having the operation as described above, the user can practice exercises requiring skill and precision and sharpen the motor nerve of the leg through stretching and bending of the ankle joint, knee joint and hip joint and swift and controlled contraction of the bending and stretching muscles. Further the balance function of the whole body can be improved through the efforts to hold the chest and head still.

Further through repeated exercises with the exercise equipment of the invention, the time during which the user can continue exercising on the equipment until he falls off can be made longer and longer. Accordingly the number of sounds generated by the loudspeaker increases as does the number of rotations of the rotatable arm indicated by the display device, thereby encouraging the user to practice willful exercises and at the same time be entertained and amused.

When the user stops his motion for turning the rotatable arm to merely remain upright on the base plate of the equipment, the rotatable arm halts in an indefinite position. Therefore, a game similar to the roulette may be played with the exercise equipment of the invention by dividing the peripheral surface of the flange 30 into sections each assigned either a number as shown by numeral 76 in FIG. 3 or a device and providing various game scores depending on the sections the arm head happens to halt. The athletes thus are each encouraged to train and improve the bodily balance function as they endeavor to halt the rotatable arm at a desired position corresponding to a certain number or device.

I claim:

1. Exercise equipment for improving the bodily balance function through active bodily movements comprising: a spherical sector-shaped member having an inner surface and an outer surface, said outer surface being adapted to contact the floor surface, a column extending radially from the center of the inner surface of said spherical sector shaped member towards the center of the sphere, a rotatable arm having a base end and a free end, a boss formed at said base end which is rotatably mounted on said column, said rotatable arm extending radially outwardly from said column and projecting beyond the outer periphery of said spherical sector-shaped member, a base plate having a periphery corresponding generally to the periphery of said spherical sector-shaped member and having upper and lower surfaces, said base plate being provided with connecting means at the center of its lower surface adapted to be fitted and secured to said column, and an electric circuit means for detecting and indicating rotation of said arm relative to said base plate.

2. Exercise equipment according to claim 1, comprising a plurality of steel balls at the upper and lower ends of the boss carried on the column, and annular support members provided on the column at the upper and lower ends of the boss so as to support said steel balls for smooth rotation of the arm.

3. Exercise equipment according to claim 1, wherein said electric circuit means is provided on a circuit board secured to the lower surface of the base plate, said circuit comprising a light emitting device and a photo detector, a reflection plate provided on the rotatable arm facing in opposition to the photo detector to reflect the light from the light emitting device as said arm moves past photo detector, an amplifier for amplifying the pulse signal produced by the photo detector, a counter circuit for adding the amplified pulse signals, and a digital display device for indicating the added amplified pulse signals.

4. Exercise equipment according to claim 3 further comprising a sound generation circuit and a loudspeaker, wherein the pulse signal from the amplifier is applied through said sound generation circuit to said loudspeaker to produce sound.

5. Exercise equipment according to claim 1, wherein the base plate has a flange at its pheriphery and the flange is divided into a plurality of sections on each of which is indicated a number or device so that the user of the exercise equipment, upon stopping his motion for turning the arm, may try, while maintaining his upright position, to halt the arm at a selected one of said sections.

* * * * *